US005735404A

United States Patent [19]

Kumakura et al.

[11] Patent Number: 5,735,404

[45] Date of Patent: Apr. 7, 1998

[54] MERCHANDISE PACKAGE AND METHOD OF MANUFACTURING THE SAME

[75] Inventors: Katsuhiko Kumakura, Kyoto; Tadashi Ono, Hirakata, both of Japan

[73] Assignee: Matsushita Electric Industrial Co., Ltd., Osaka-fu, Japan

[21] Appl. No.: 643,684

[22] Filed: May 6, 1996

[30] Foreign Application Priority Data

May 11, 1995 [JP] Japan ..... 7-113420
Dec. 12, 1995 [JP] Japan ..... 7-323262

[51] Int. Cl.[6] ..... B65D 85/08

[52] U.S. Cl. ..... 206/469; 206/459.5; 206/497; 206/705; 493/63

[58] Field of Search ..... 206/461–471, 206/705, 497, 459.5; 493/63, 73

[56] References Cited

U.S. PATENT DOCUMENTS

| | | | |
|---|---|---|---|
| 3,382,972 | 5/1968 | Phipps | 206/469 |
| 3,599,787 | 8/1971 | Webster, Jr. | 206/469 |
| 3,685,648 | 8/1972 | Heller | 206/462 |
| 4,311,234 | 1/1982 | Wildgoose | 206/469 |
| 4,803,048 | 2/1989 | Nason | 206/469 |
| 4,971,197 | 11/1990 | Worley | 206/705 |
| 5,052,992 | 10/1991 | Hyder | 493/73 |
| 5,188,231 | 2/1993 | Kivell et al. | 206/705 |
| 5,311,989 | 5/1994 | Ward et al. | 206/705 |
| 5,413,221 | 5/1995 | Mizuno . | |
| 5,429,233 | 7/1995 | Juaristi | 206/705 |
| 5,579,910 | 12/1996 | Bennett | 206/469 |

FOREIGN PATENT DOCUMENTS

| | | | |
|---|---|---|---|
| 2138364 | 1/1973 | France . | |
| 2355734 | 1/1978 | France . | |
| 2433469 | 3/1980 | France . | |
| 2578515 | 9/1986 | France . | |
| 63-299049 | 12/1988 | Japan . | |
| 2-278655 | 11/1990 | Japan . | |
| 1144337 | 8/1966 | United Kingdom . | |
| 2003819 | 3/1979 | United Kingdom | 206/469 |
| 2 258 647 | 2/1993 | United Kingdom . | |

*Primary Examiner*—Jimmy G. Foster
*Attorney, Agent, or Firm*—Panitch Schwarze Jacobs & Nadel, P.C.

[57] ABSTRACT

A merchandise package (1) for packing articles (40) having a packing part (3, 3') including a substantially transparent plastic shrink-packing film for containing therein at least an article (40) which is directed to the same direction, the packing part being contained and held between a mounting board (2) and a holding part ( 4).

15 Claims, 17 Drawing Sheets

MERCHANDISE PACKAGE AND METHOD OF MANUFACTURING THE SAME

FIELD OF THE INVENTION AND RELATED ART STATEMENT

1. Field of the Invention

The present invention relates to a merchandise package for packing and exhibiting small articles such as batteries for selling them, and a method of manufacturing the same.

2. Description of the Prior Art

In recent years, as a merchandise package for packing daily miscellaneous goods such as batteries and toiletries or processed food, a blister package is widely used because of an exhibition effect at stores and cheap cost. In the blister package, a dent or dents are thermally formed in a transparent synthetic resin sheet, and an article or articles are packed in the dent. A peripheral part surrounding the dent is bonded to a mounting board such as a paper board, so that an opening of the dent is closed and the article is held.

As an example of a conventional merchandise package, a battery package for packing batteries will be explained with reference to FIG. 16 and FIG. 17.

FIG. 16 is a front view showing a conventional battery package. FIG. 17 is an exploded perspective view showing the conventional battery package shown in FIG. 16.

In FIG. 16, a conventional battery package 51 comprises a mounting board 52 formed by a paper board, and a holding part 53, which is formed by a transparent synthetic resin sheet, for packing a plurality of, for example four, batteries 40. In order to hang the battery package 51 by means of a pin or the like at a store, the mounting board 52 has a hanging hole **52*a*. Perforations 52*b* is formed in the mounting board 52 so as to surround an opening of the below-mentioned dent 53*a* with a lower edge of the mounting board 52. In order to open the battery package 51, a cutting part 52*c* (FIG. 17) defined by the perforations 52*b* and the lower edge of the mounting board 52 is separated from the mounting board 52, so that the batteries 40 can be taken out from the battery package 51** (as described in detail later).

The holding part 53 comprises a dent **53*a* for containing the batteries 40 arranged parallel to each other in a horizontal direction, a collar part 53*b* disposed around the opening of the dent 53*a* and to be bonded to the mounting board 52, and a pair of leg parts 53*c* disposed to a lower end of the dent 53*a***.

The dent **53*a* and the leg parts 53*c* are formed by thermoforming a sheet-like shaped synthetic resin with a metal mold. In order to put the batteries 40 into the dent 53*a* easily, the outer shape of the dent 53*a* is formed larger than the outer shape of the batteries 40 by some margins around the outer shape of the batteries 40. A bottom surface of the leg parts 53*c* flushes with the lower edge of the mounting board 52. Therefore, the battery package 51 can stand upright at the bottom surface of the leg parts 53*c* and the lower edge of the mounting board 52** for the purpose of exhibition.

As shown in FIG. 17, after putting each one of the batteries 40 by hand into the holding part 53 positioned downward, the mounting board 52 and the collar part **53*b* are bonded to each other by a hot pressing machine with a heat sensitive and pressure sensitive adhesive. Thereby, the battery package 51** is completed.

During a packing operation of the batteries 40, a facing operation is performed in Which the four batteries 40 are directed to the same direction and packed into the dent **53*a***.

That is, in general, on the outer peripheral surface of each battery 40, there is a space or part which displays the type, the grade, the manufacturer's name and the like of the battery 40 (hereinafter referred to as a "front face"). Each one of the batteries 40 is put into the dent **53*a* in such a manner that the front face is directed to the front side of the battery package 51** in the facing operation.

As has been explained in the above, the mounting board 52 has the cutting part **52*c* defined by the perforations 52*b* and the lower edge of the mounting board 52. The cutting part 52*c* holds the batteries 40 with the dent 53*a* substantially. The cutting part 52*c* is formed a little larger than the opening of the dent 53*a*. A lower end portion of the cutting part 52*c* is bonded to the collar part 53*b***.

When a customer, a seller or the like wants to open the conventional battery package 51, he must inserts his nail between the collar part **53*b* and a lower edge 52*c*1 of the cutting part 52*c*. Successively, he strips the lower end portion of the cutting part 52*c*, which is bonded to the collar part 53*b*, away from the collar part 53*b*. Thereafter, he holds the lower end portion of the cutting part 52*c*, and tears the perforations 52*b* from the lower end side of the mounting board 52. As a result, the cutting part 52*c* is separated from the mounting board 52, and the dent 53*a*** is opened.

Thus, when the customer or seller wishes to take the article packed in the conventional merchandise package, he must remove the adhesion between the collar part and the lower end portion of the cutting part, and tears the perforations from the lower end side of the mounting board. Thereby, he opens the dent by separating the cutting part from the mounting board, and the article can be taken out the conventional merchandise package.

In the conventional merchandise package, as has been explained in the above, each one of the batteries is packed into the dent with the facing operation. Such packing operation including the facing operation has been difficult to automatize, and the packing operation has been manually performed. Therefore, there is a problem that the packing operation takes a long time. Furthermore, there is a possibility that rust is made on the batteries by adhesion contamination with sweat from hands and fingers in the packing operation.

Furthermore, the outer shape of the dent is formed larger than the outer shape of the batteries. Thereby, after packing the batteries into the battery packager the batteries can and make individual rotation in the dent at vibration or the like during transportation. Accordingly, there is a possibility that visual confirmation of the type, the grade, the manufacturer's name and the like of the batteries becomes difficult, because all front faces can not be visually confirmed and/or the front faces are put to various different directions with each other.

As a countermeasure for preventing rotation of the batteries, for example, Japanese examined Patent publication Hei No. 6-79476 discloses that plural small projections projecting toward the mounting board are formed inside of the dent. That is, in the conventional battery package, each one of the batteries is held and fixed between the plural small projections in the dent, so that all front faces are fixed to the front side of the battery package.

However, in the conventional battery package having the small projections, the operability of packing the batteries is low because of the plural small projections. Thereby, there is a problem that work hour of the packing operation is inevitably long. Furthermore, it is necessary to form the dent into a complex configuration, so that the holding part needs to be formed with a high processing accuracy.

Furthermore, in the conventional merchandise package, the lower end portion of the cutting part, namely, the cutting start part of the cutting part is adhered to the collar part by the adhesive. Therefore, when the conventional merchandise package is opened, it is necessary to strip away the bonded part between the cutting start part and the collar part by an insertion of the nail or the like therebetween. Hence, there is a problem that opening of the conventional merchandise package takes time and labor.

Moreover, since the cutting part is formed larger than the opening of the dent, it is difficult to keep the unused batteries in the conventional merchandise package after once opening the conventional merchandise package. For example, if the once opened the conventional merchandise package still containing some articles therein is hung to a pin with the hanging hole, there is a possibility that the articles, e.g. unused batteries may fall off from the dent.

Moreover, since the batteries are packed without individual sealing, there is a possibility that rusts is generated on terminal parts of the unused batteries by sticking of sweat from finger or the like. As a result, there is a problem that the quality of the unused batteries is deteriorated. Furthermore, if a used article would happen to be inserted by mischief into a conventional merchandise package which is being exhibited, it is impossible to judge whether this article is a used article.

Thus, after the conventional merchandise package is opened, the maintainability of the article deteriorates, and it is impossible to guarantee that the article left in the conventional merchandise package is a new article.

OBJECT AND SUMMARY OF THE INVENTION

The object of the present invention is to provide such a merchandise package for packing articles that can solve the aforementioned problems.

In order to achieve the above-mentioned object, a merchandise package for packing articles in accordance with the present invention comprises:

a mounting board, a packing part including a substantially transparent plastic shrink-packing film for containing therein at least an article, and a holding part having a dent for containing the packing part and a collar part to be bonded to the mounting board, the holding part holding the packing part in cooperation with the mounting board.

According to the merchandise package of the present invention, the packing part is constituted with the shrink-packed articles and the packing part is contained in the holding part, so that a packing operation of the articles is almost automatized. Furthermore, the articles are shrink-packed. Thereby, even after packing of the articles in the merchandise package, rotation of the articles is prevented. As a result, visual confirmation of the type, the grade, the manufacturer's name and the like of the articles is obtainable without any inconvenience.

While the novel features of the invention are set forth particularly in the appended claims, the invention, both as to organization and content, will be better understood and appreciated, along with other objects and features thereof, from the following detailed description taken in conjunction with the drawings.

DESCRIPTION OF THE PREFERRED EMBODIMENTS

Hereafter, preferred embodiments of the present invention are described with reference to the accompanying drawings. As an example of the merchandise packages of the present invention, a battery package for packing batteries will be described.

<<FIRST EXAMPLE>>

Figure 1:
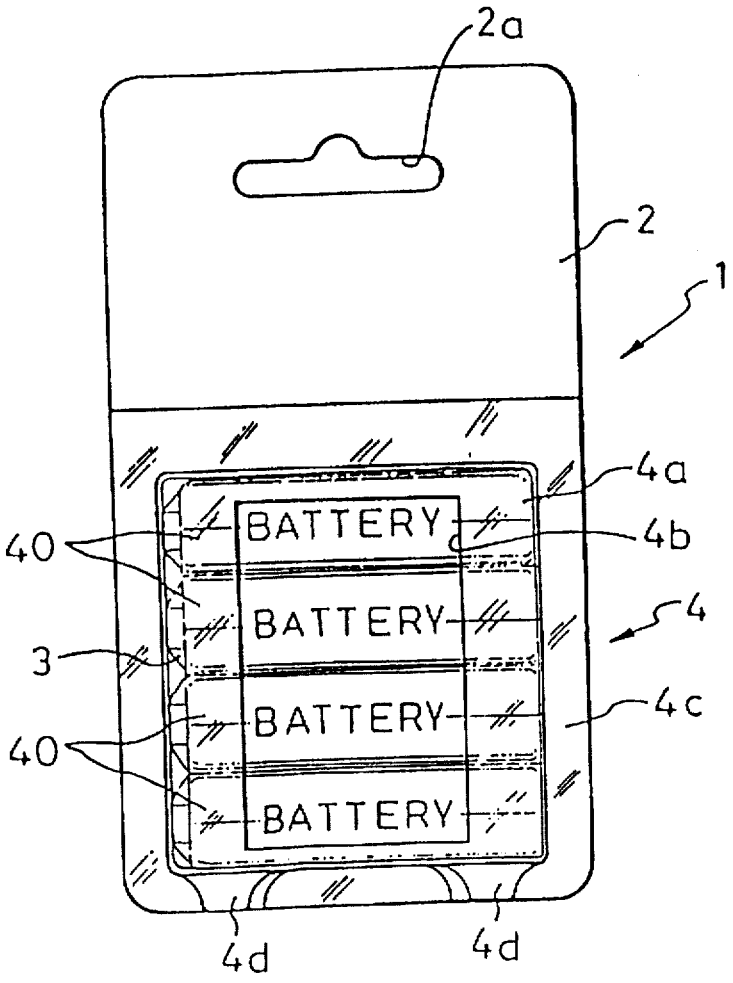
FIG. 1 is a front view showing a battery package of a first example of the present invention.
Figure 2:
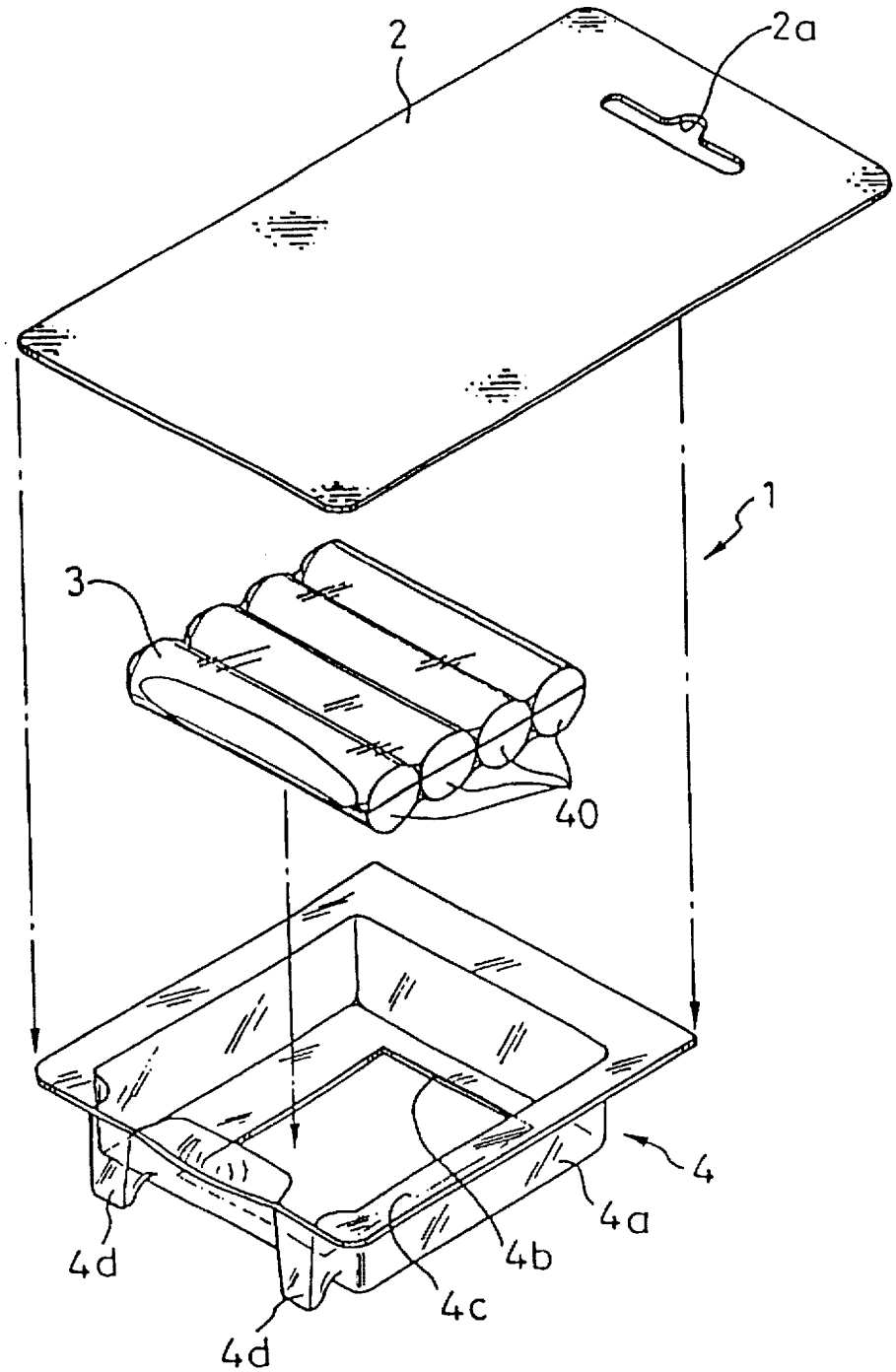
FIG. 2 is an exploded perspective view showing the battery package shown in FIG. 1.

FIG. 1 is a front view showing a battery package of a first example of the present invention. FIG. 2 is an exploded perspective view showing the battery package shown in FIG. 1.

In FIG. 1, the battery package 1 comprises a mounting board 2 of a paper board, a packing part 3 made of a transparent synthetic resin in which a plurality of, for example four, batteries 40 are shrink-packed parallel to each other, and a holding part 4 for containing and holding the packing part 3 in cooperation with the mounting board 2. In order to hang the battery package 1 on a pin in a store, the mounting board 2 has a hanging hole 2a. In a shrink-package forming the packing part 3, it is known that plural, for example four, batteries 40 are fixed and sealed integrally, so that they are generally sold at one time. The quality of the batteries 40 is not deteriorated since the shrink-package is not opened before selling. A shrink-packing process is directly linked to an end part of a production line for manufacturing the batteries 40. In the end part of the production line, the batteries 40 which are transported in a line so that each of the negative poles of the batteries 40 is put down. Furthermore, in the end part of the production line, photoelectric tube detection is made on the batteries 40, whereby a part of each battery 40 which displays the type, the grade, the manufacturer's name and the like of the battery 40 (hereinafter referred to as a "front face") is detected. The batteries 40 are transported with the front face directed to one direction which is perpendicular to the direction of transportation. Therefore, in the packing part 3, the four batteries 40 are shrink-packed with the front faces directed to the same direction. As a result, when the packing part 3 is put into the below-mentioned dent 4a, a facing operation to direct all front faces to the front side of the battery package 1 can be performed easily. Thereby, it is possible to pack the batteries 40 quickly. Furthermore, the batteries 40 are tightly shrink-packed with all front faces in the same direction and fixed to each other. Thereby, the batteries 40 do not rotate in the battery package 1 after packing in the battery package 1. As a result, visual confirmation of the type, the grade, the manufacturer's name and the like of the batteries can be realized without any trouble.

The holding part 4 comprises the dent 4a for containing the packing part 3, a window part 4b in which the dent 4a is formed in a rectangular shape of a predetermined size, a collar part 4c, which is disposed around the dent 4a, for bonding to the mounting board 2, and a pair of leg parts 4d disposed to a lower end of the dent 4a. The outer shape of the dent 4a is formed larger than the outer shape of the packing part 3 in order to put the packing part 3 into the dent 40 easily. The window part 4b is disposed on the front side of the battery package 1. As a result, it is possible to reduce a surface area which covers the packing part 3 of the holding part 4. Thereby, a customer can clearly confirm the type, the grade, the manufacturer's name and the like of the batteries. Furthermore, a bottom surface of the leg parts 4d flushes with a lower edge of the mounting board 2. Therefore, the battery package 1 can stand upright at the bottom surface of the leg parts 4d and the lower edge of the mounting board 2 for the purpose of exhibition.

As shown in FIG. 2, the packing part 3 is put into the dent 4a of the holding part 4 placed downward by hand so that the front faces are directed to the front side of the battery package 1. Thereafter, the mounting board 2 and the collar part 4c are bonded to each other by a hot press machine with a heat sensitive and pressure sensitive adhesive. Thereby, the battery package 1 is completed.

Apart from the aforementioned explanation, wherein the four batteries 40 are packed and held into the battery package 1 in a lying position as shown in FIG. 1, an alternative construction may be such that the four batteries 40 are packed and held into the battery package 1 in a standing position.

Furthermore, apart from the aforementioned explanation, wherein the front faces of the four batteries 40 are directed to the same direction, an alternative construction may be such that four outer peripheral surfaces, which are arranged on the front side of the battery package 1, of the four batteries 40 may be combined to each other so that the type, the grade, the manufacturer's name and the like of the batteries 40 are displayed.

<<SECOND EXAMPLE>>

Figure 3:
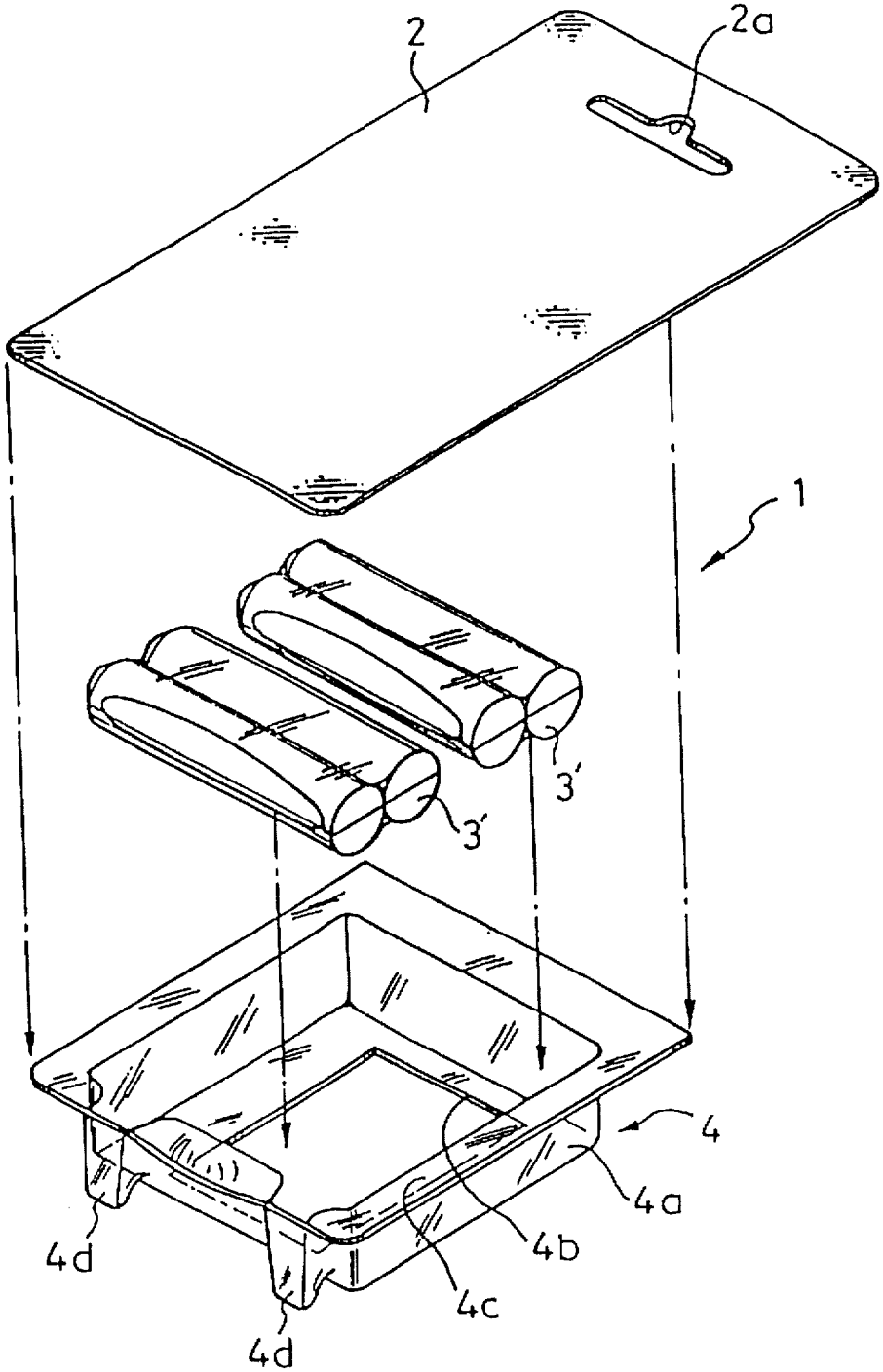
FIG. 3 is an exploded perspective view showing a battery package of a second example of the present invention.

FIG. 3 is an exploded perspective view of a battery package in a second example of the present invention. In this second example, the battery package 1 is fundamentally the same as that of the first example except for the packing part. Therefore, corresponding parts and components to the first example are shown by the same numerals and marks, and the description thereon made in the first example similarly apply. In the following description, differences of this second example from the first example are mainly explained. There are differences that two packing parts 3' each shrink-packing two batteries 40 are used instead of the packing part 3 (FIG. 2) shrink-packing four batteries 40.

As shown in FIG. 3, the two packing parts 3' are disposed into the dent 4a in two-stage. As a result, when only two or less batteries 40 are used, only one of the two packing parts 3' may be opened. Thereby, the quality of unused batteries 40 can be maintained, and it is possible to recognize the unused batteries 40 easily. Furthermore, one battery 40 may be shrink-packed to form the packing part.

<<THIRD EXAMPLE>>

Figure 4A:
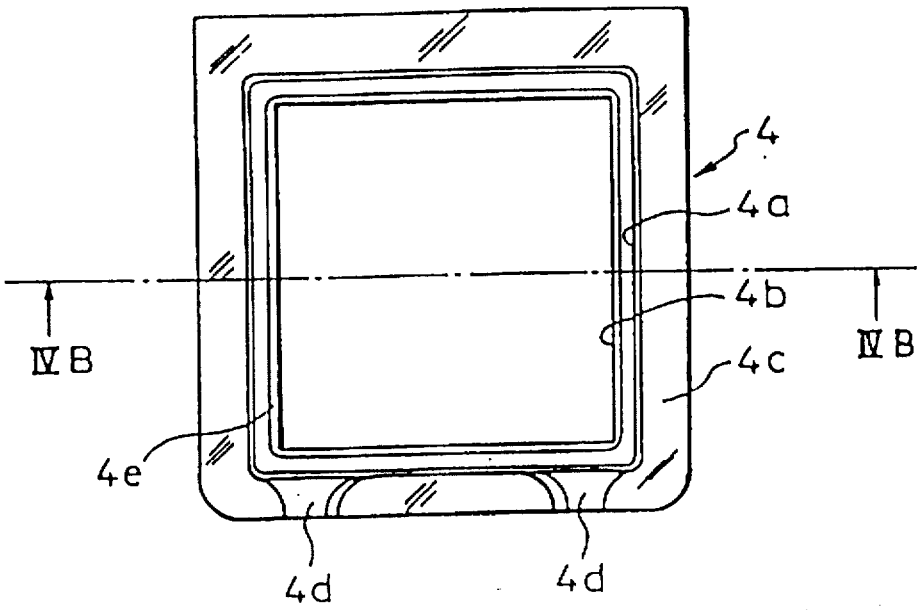
FIG. 4A is a front view showing a holding part in a third example of the present invention.
Figure 4B:
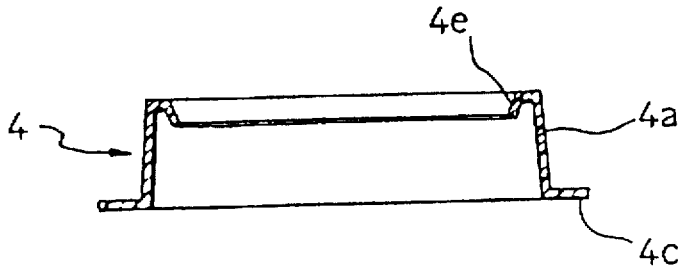
FIG. 4B is a cross sectional view, which is taken on line IVB—IVB, showing the holding part of FIG. 4A.
Figure 5:
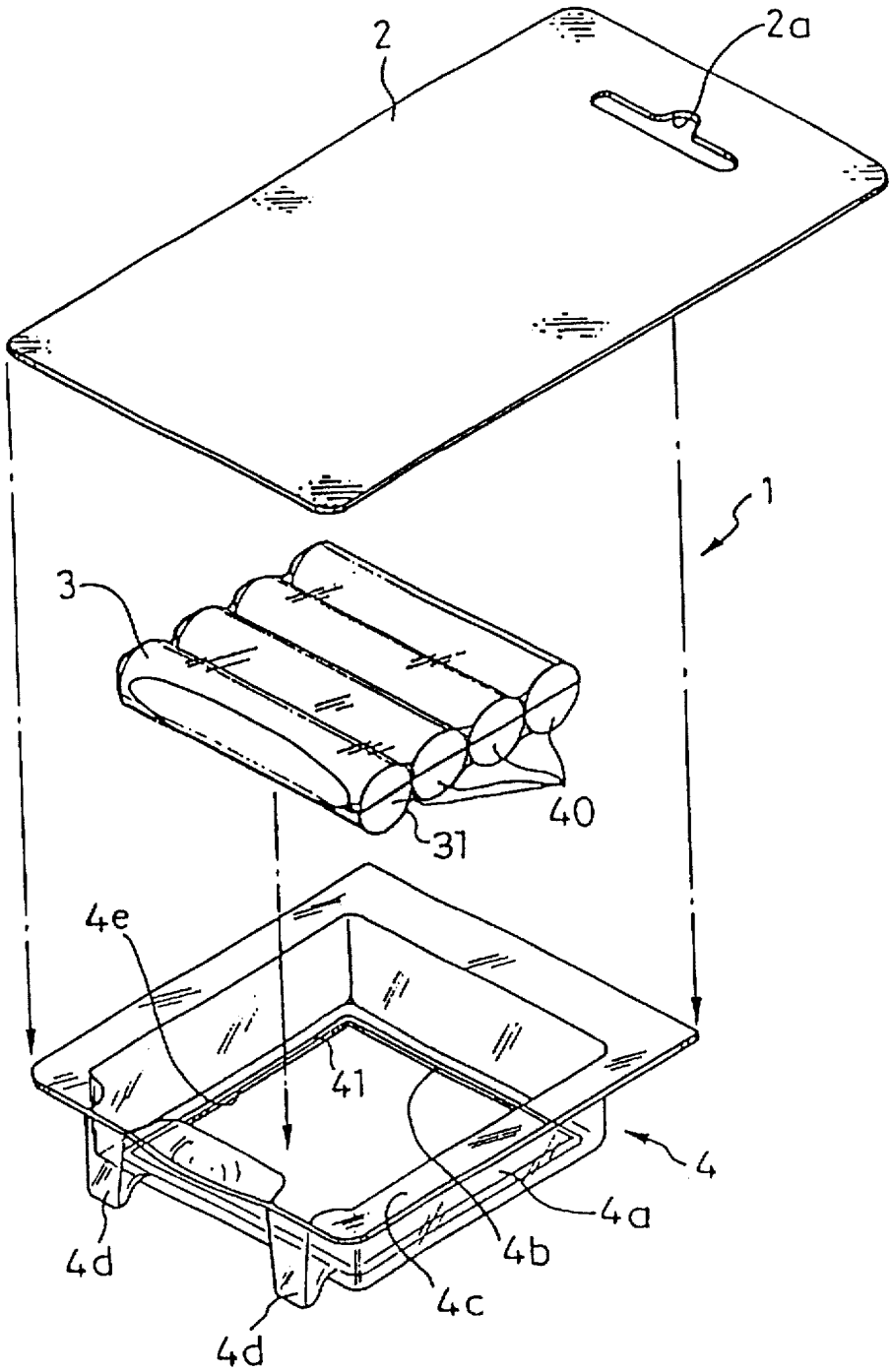
FIG. 5 is an exploded perspective view showing the battery package of the third example of the present invention.

FIG. 4A is a front view showing a holding part in a third example of the present invention, and FIG. 4B is a cross sectional view, which is taken on line IVB—IVB, showing the holding part of FIG. 4A. FIG. 5 is an exploded perspective view of the battery package in the third example of the present invention. In this third example, the battery package 1 is fundamentally the same as that of the first example except for the holding part. Therefore, corresponding parts and components to the first example are shown by the same numerals and marks, and the description thereon made in the first example similarly apply. In the following description, differences of this third example from the first example are mainly explained. There are differences that the dent 4a includes a folded part 4e.

As shown in FIGS. 4A and 4B, the folded part 4e is formed by folding the end part of the dent 4a at a periphery of the window part 4b from the front side of the battery package 1 toward inside of the dent 4a. As a result, the folded part 4e is formed at the periphery of the window part 4b. Thereby, it is possible to increase the strength of the dent 4a at the front side of the battery package 1. As a result of the strengthened front side, an opening of the window part 4b can become larger in comparison with that of the first example. A top edge of the folded part 4e, that is, a cut edge of the 4b is directed toward the inside the dent 4a of the battery package 1. Thereby, there is no fear of scratching fingers, laceration, etc. of the finger tip by the cut edge.

Furthermore, as shown in FIG. 5, when the packing part 3 is contained in the dent 4a, the packing part 3 is contained and held between the mounting board 2 and the folding part 4e so that the outer surface of the packing part 3 is mounted on the top edge of the folded part 4. As a result, the packing part 3 is held inside the dent 4e with its packed face 31 offset from the front end of the battery package 1 by a distance between an end tip 41 of the folded part 4e and the window part 4b. Thereby, it is possible to prevent the shrink package of the packing part 3 from getting tore by a nail or the like in comparison with that of the first example.

<<FOURTH EXAMPLE>>

Figure 6:
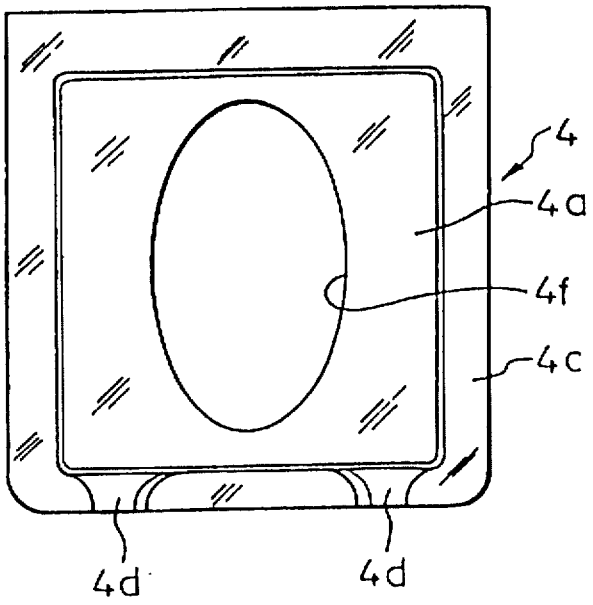
FIG. 6 is a front view showing a holding part of a battery package in a fifth example of the present invention.

FIG. 6 is a front view showing a holding part of a battery package in a fourth example of the present invention. In this fourth example, the battery package 1 is fundamentally the same as that of the first example except for the window part. Therefore, corresponding parts and components to the first example are shown by the same numerals and marks, and the description thereon made in the first example similarly apply. In the following description, differences of this fourth example from the first example are mainly explained. There are differences that a window part 4*f* is formed into an oval shape.

As shown in FIG. 6, the dent 4*a* is cut out in the oval shape on the front side of the battery package 1, so that the window part 4*f* is formed.

In this embodiment, since the edge of the window part 4*f* is formed with round curved line, there is less possibility of making cracks from the corners of the window part 4*b* in comparison with that of the first example. As a result, it is possible to reduce occurrence of laceration on finger.

<<FIFTH EXAMPLE>>

Figure 7A:
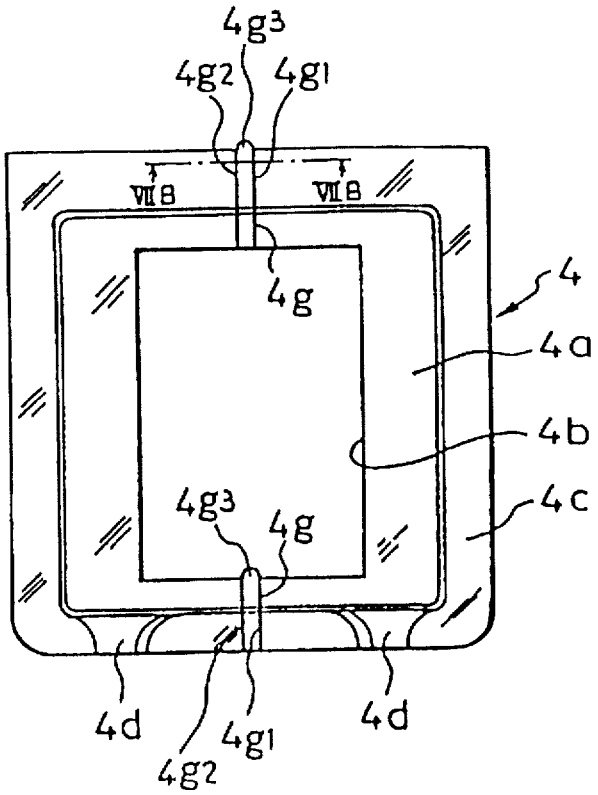
FIG. 7A is a front view showing a holding part of a battery package in a fifth example of the present invention.
Figure 7B:
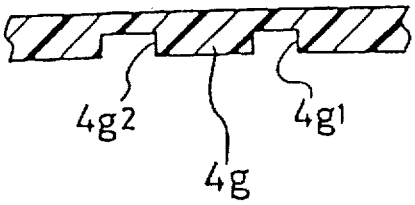
FIG. 7B is an enlarged cross sectional view, which is taken on line VIIB—VIIB, showing the holding part of FIG. 7A.

FIG. 7A is a front view showing a holding part of a battery package in a fifth example of the present invention. FIG. 7B is an enlarged cross sectional view, which is taken on line VIIB—VIIB, showing the holding part of FIG. 7A. In this fifth example, the battery package 1 is fundamentally the same as that of the first example except for the holding part. Therefore, corresponding parts and components to the first example are shown by the same numerals and marks, and the description thereon made in the first example similarly apply. In the following description, differences of this fifth example from the first example are mainly explained. There are difference that a separating part 4*g* is made by forming two narrow gap half cut-out parts 4*g*1 and 4*g*2 with a predetermined distance therebetween on the dent 4*a* and the collar part 4*c* at the upper part of FIG. 7A, and that the similar separating part 4*g* is made also at the lower part.

As shown in FIG. 7A, for example, the half cut-out parts 4*g*1 and 4*g*2 are formed on the dent 4*a* and the collar part 4*c* extending between the window part 4*b* and the upper edge of the collar part 4*c*. As shown in FIG. 7B, the half cut-out parts 4*g*1 and 4*g*2 are formed by cutting by half thickness of the holding part 4. As a result, when each protruded parts 4*g*3 of the separating parts 4*g* are pulled away so as to remove the separating part 4*g* from the holding part 4, the packing part 3 can be easily taken out the holding part 4.

The half cut-out parts 4*g*1 and 4*g*2 are formed either on one of the front face or the rear face of the holding part 4. Furthermore, the half cut-out parts 4*g*1 and 4*g*2 may be formed in a perforated shape.

<<SIXTH EXAMPLE>>

Figure 8:
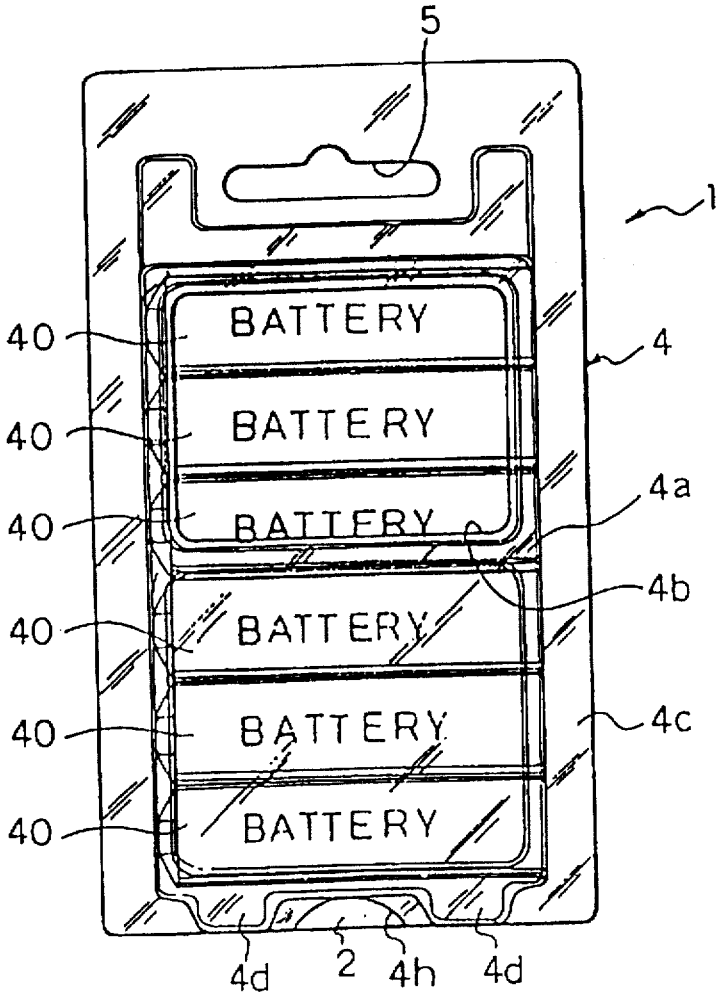
FIG. 8 is a front view of a battery package according to a sixth example of the present invention.
Figure 9:
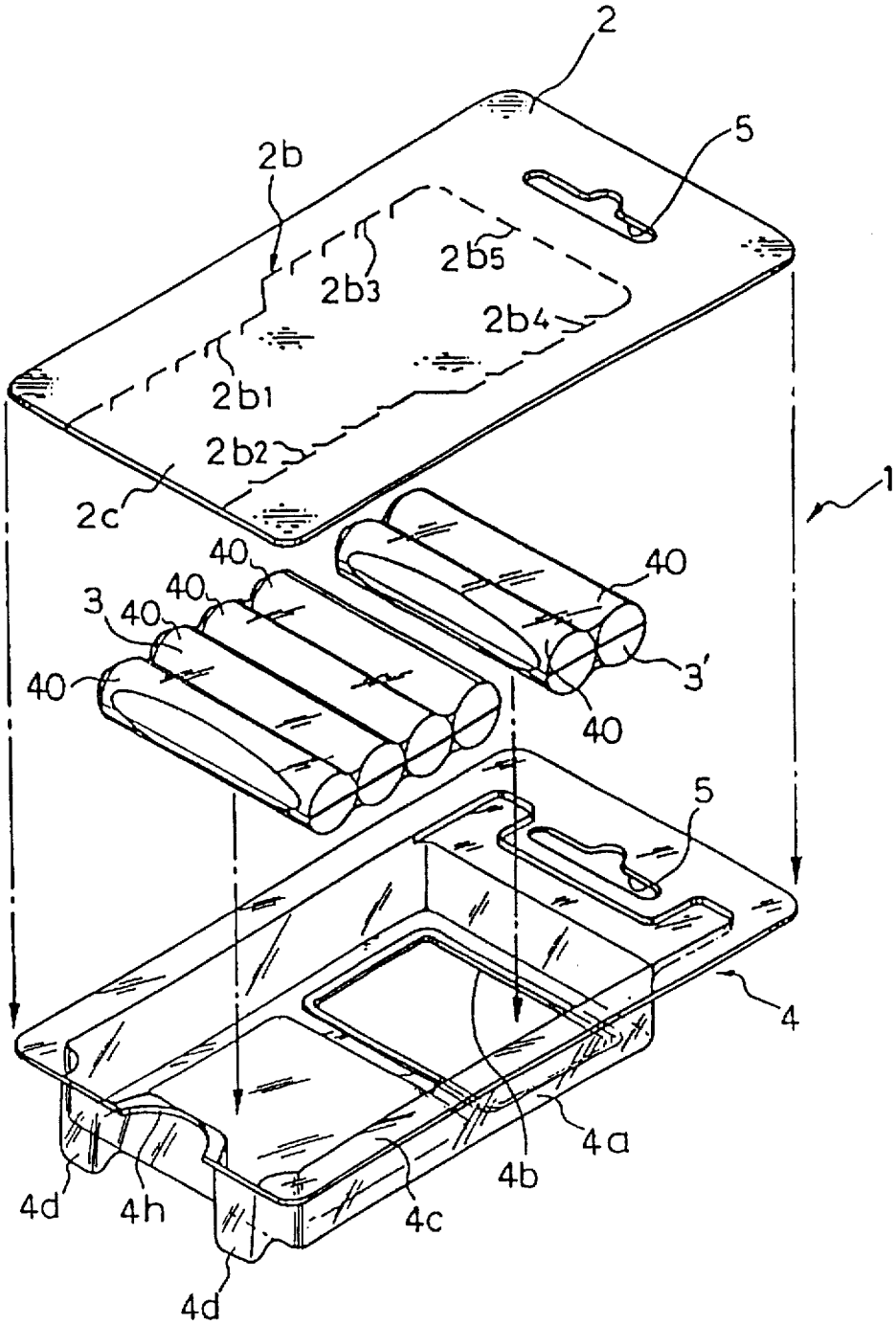
FIG. 9 is an exploded perspective view showing the battery package shown in FIG. 8.

FIG. 8 is a front view of a battery package in a sixth example of the present invention. FIG. 9 is an exploded perspective view of the battery package shown in FIG. 8. In this sixth example, the battery package 1 is fundamentally the same as that of the first example except for the mounting board and the holding part. Therefore, corresponding parts and components to the first example are shown by the same numerals and marks, and the description thereon made in the first example similarly apply. In the following description, differences of this sixth example from the first example are mainly explained. There are differences that a perforation 2*b* having a predetermined configuration is formed in the mounting board 2 and a cut-out part 4*h* is formed in the collar part 4*c* of the holding part 4 which entirely covers the mounting board 2.

In FIG. 8, the holding part 4 entirely covers the mounting board 2, and the mounting board 2 and the collar part 4*c* of the holding part 4 are bonded to each other. In the collar part 4*c*, the cut-out part 4*h* is formed between the pair of the leg parts 4*d*. The cut-out part 4*h* is formed by creating an arc-shaped cutting which opens toward the lower edge of the mounting board 2 in the collar part 4*c*. Furthermore, the cut-out part 4*h* is disposed between the below-mentioned first and second perforations 2*b*1 and 2*b*2 (FIG. 9). A hanging hole 5 is formed in a top end portion of the battery package 1 for hanging the battery package 1 at the store as well as that of the first example. The hanging hole 5 is opened simultaneously on the mounting board 2 and the holding part 4, after each-other bonding the mounting board 2 and the holding part 4.

As shown in FIG. 9, in the mounting board 2, the perforation 2*b* is formed in a predetermined configuration from the lower edge of the mounting board 2. Thereby, the cutting part 2*c* is defined by the perforation 2*b* and the lower edge of the mounting board 2. In the case that the battery package 1 is opened, the cutting part 2*c* is torn away from the mounting board 2 along the perforation 2*b* from the lower edge of the mounting board 2. As has been explained in the above, the cut-out part 4*h* is disposed between the first and the second perforations 2*b*1 and 2*b*2. Therefore, when the cutting part 2*c* is torn away from the mounting board 2, bending force by finger is like to be given to the first and the second perforations 2*b*1 and 2*b*2 easily. As a result, it is possible to open and take out the battery package 1 easily.

Figure 10:
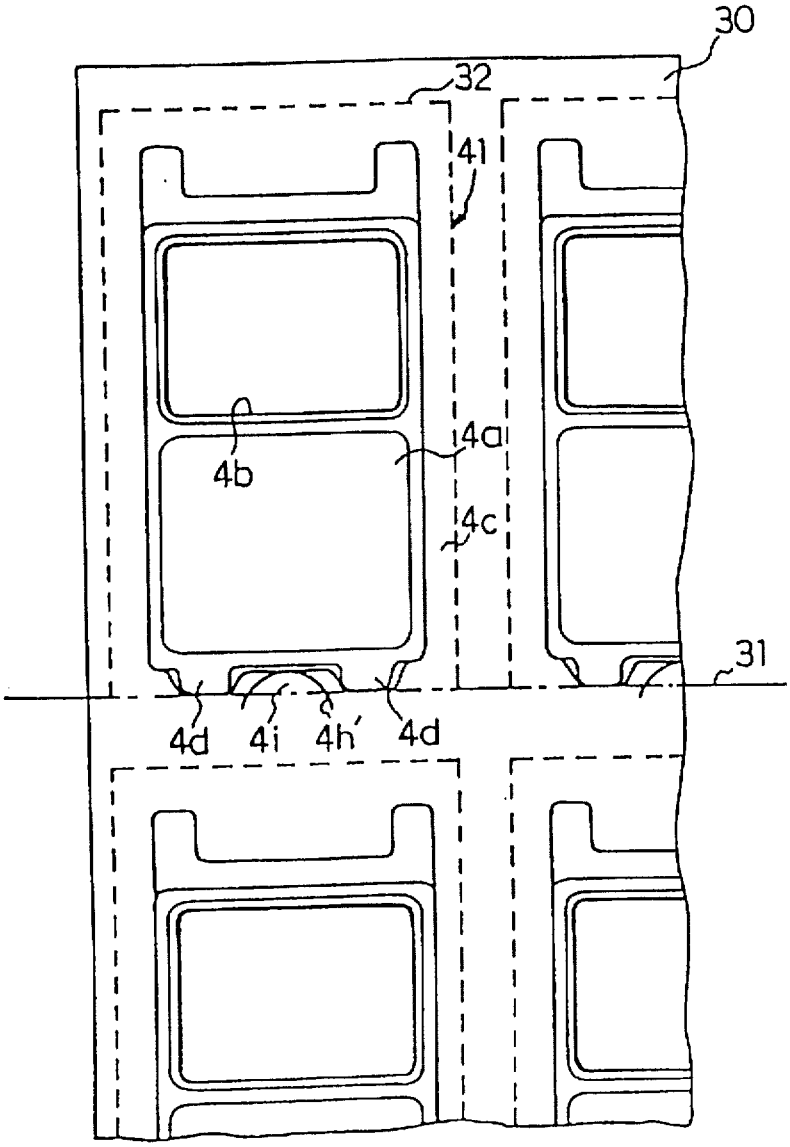
FIG. 10 is an explanatory view showing a method of forming a cut-out part of the battery package shown in FIG. 8.

A method of forming the cut-out part 4*h* will be elucidated with reference to FIG. 10 concretely.

As shown in FIG. 10, a plurality of identical metal molds (not shown) are heated and pressed against a synthetic resin sheet 30 having a predetermined size, e.g., 400 mm×270 mm. Thereby the aforementioned dent 4*a*, the window part 4*b* and the pair of the leg parts 4*d* are formed. In the metal molds, sectional shape of it's blade is formed in an arc-shape. Thereby, when the blade penetrates the synthetic resin sheet 30, arc-shaped cuts 4*h*' are formed in the synthetic resin sheet 30.

The holding part 4 is placed downward, and the packing part 3 and 3' are manually put into the dent 4*a* so that the front faces are directed to the front side of the battery package 1. Successively, a mounting board having the same size as the synthetic resin sheet 30 is bonded to the synthetic resin sheet 30 by a hot pressing machine with the heat sensitive and pressure sensitive adhesive. During bonding of the mounting board and the synthetic resin sheet 30, the adhesive is not supplied to a portion 4*i* disposed between the first and the second perforations 2*b*1 and 2*b*2. By cutting the mounting board and the synthetic resin sheet 30 at a dot and dashed line 31 in FIG. 10, the portion 4*i* is cut off from the collar part 4*c*, whereby the cut-out part 4*h* (FIG. 8) is formed in the collar part 4*c*. The battery package 1 is formed by cutting the mounting board and the synthetic resin sheet 30 at the dot line 32.

Apart from the aforementioned explanation, wherein the adhesive is not supplied to the portion 4*i* an alternative construction may be such that the adhesive is supplied to the portion 4*i*. Thereby, when the battery package 1 is opened, the portion 4*i* bonded to the mounting board may be cut off from the collar part 4*c*, so that the cut-out part 4*h* is formed in the lower end part of the collar part 4*c*. Furthermore, a perforated cut-out portion may be formed instead of the cuts 4h', or a half cut-out part 4h' may be formed by inserting the arc-shaped blade by halfway in the arc-shaped cutting of the thickness of the synthetic resin sheet 30.

The perforation 2b will be elucidated in detail with reference to FIG. 9.

Figure 11:
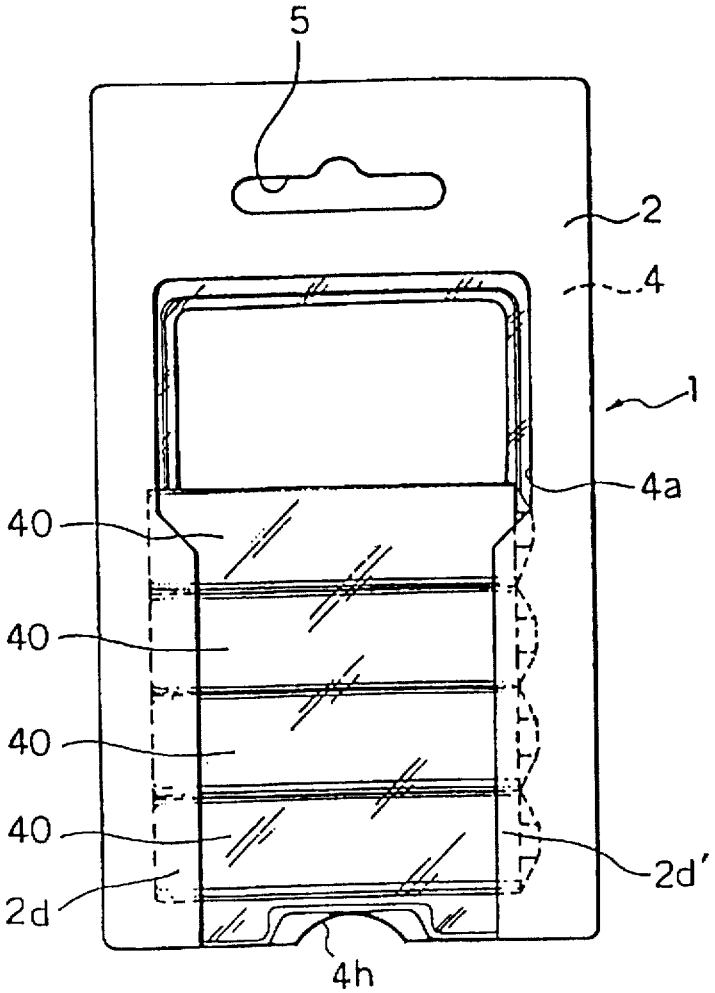
FIG. 11 is a rear view showing a state after the battery package of FIG. 8 is opened.

As shown in FIG. 9, the perforation 2b has the first and the second perforations 2b1 and 2b2 disposed parallel to each other and extending from the lower edge of the mounting board 2, a third and a fourth perforations 2b3 and 2b4 disposed parallel to each other, and a fifth perforation 2b5 disposed parallel to the lower edge of the mounting board 2. One ends of the third and the fourth perforations 2b3 and 2b4 are connected to the first and the second perforations 2b1 and 2b2, respectively. The other ends of the third and the fourth perforations 2b3 and 2b4 are connected to one end and the other end of the fifth perforation 2b5, respectively. Distance between the first and the second perforations 2b1 and 2b2 is smaller than opening width of the opening of the dent 4a of the holding part 4. Distance between the third and the fourth perforations 2b3 and 2b4 is substantially the same as the opening width of the opening of the dent 4a. Therefore, even after opening of the battery package 1, as shown in FIG. 11 for example, four unused batteries 40 are held between the dent 4a and protruded parts 2d and 2d' of the mounting board 2 which are left uncutting part.

As has been explained in the above, in the battery package 1 of the present example, the two perforations 2b1 and 2b2 are formed with a predetermined distance therebetween on the mounting board 2 extending from one edge to the other edge of the mounting board 2. Furthermore, the cut-out part 4h opening toward the one edge of the mounting board 2 is formed in the collar part 4c between the two perforations 2b1 and 2b2. Accordingly, it is possible that the two perforations 2b1 and 2b2 are torn away only by giving a moderate force on such part of the mounting board 2 that faces to the cut-out part 4h. As a result, the battery package 1 can be opened easily.

As has been explained in the above, the distance between two perforations 2b1 and 2b2 is smaller than the opening width of the opening of the dent 4a. Thereby, when the battery package 1 is opened by cutting the mounting board 2 along the perforations 2b1 and 2b2, it is possible to keep the batteries 40 between the dent 4a and the protruded parts 2d and 2d' of the mounting board 2 left uncutting part.

<<SEVENTH EXAMPLE>>

Figure 12:
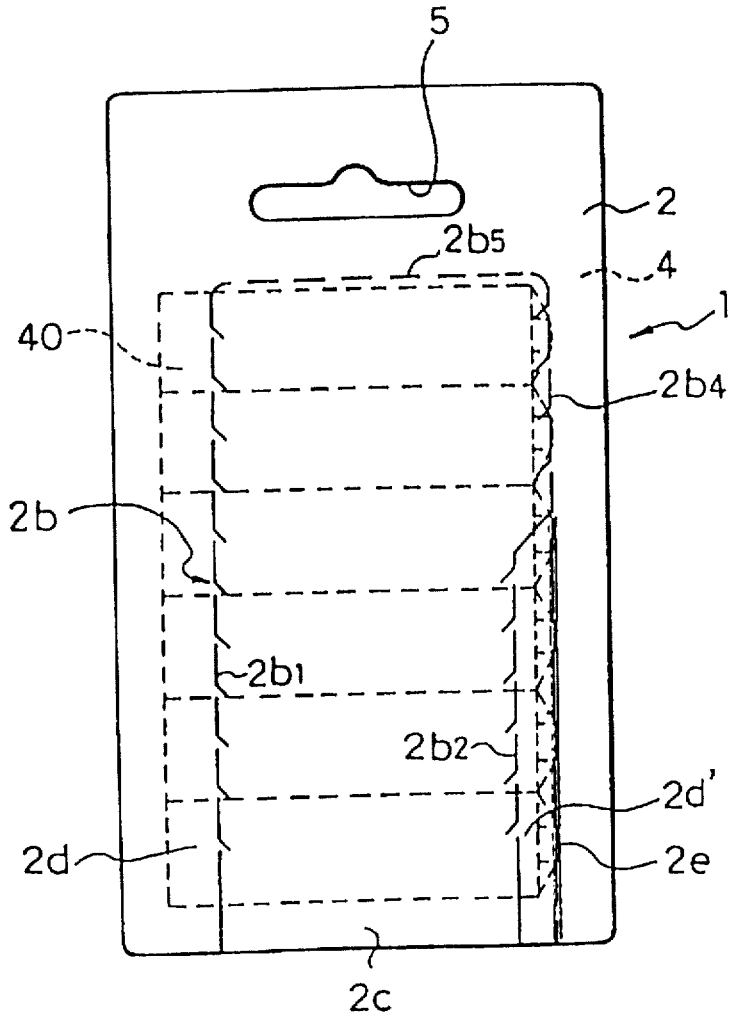
FIG. 12 is a rear view showing a battery package in a seventh example of the present invention.
Figure 13A:
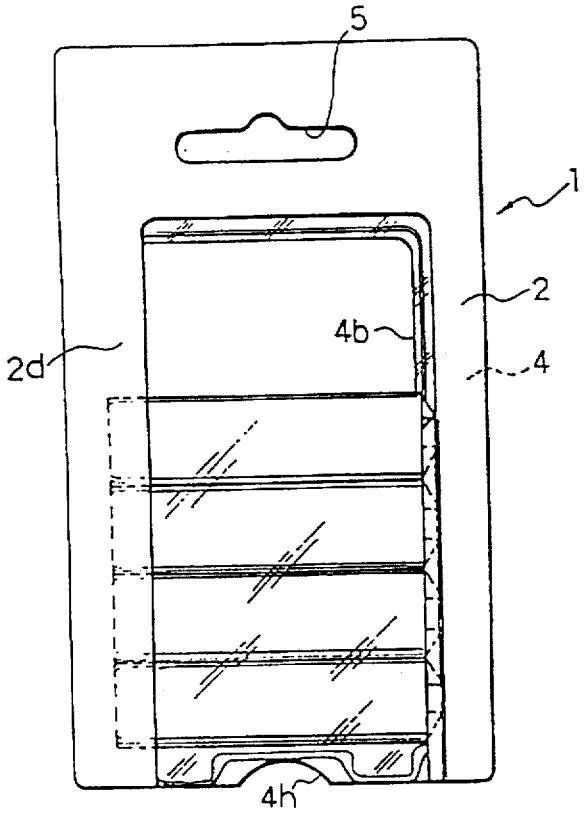
FIG. 13A is a rear view showing a state after opening the battery/package of FIG. 12.
Figure 13B:
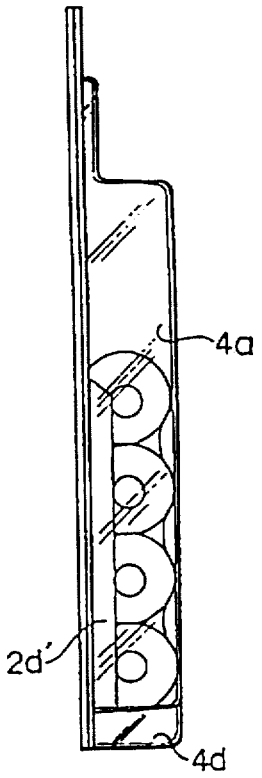
FIG. 13B is a side view showing a state after opening the battery package of FIG. 12.

FIG. 12 is a rear view showing a battery package in a seventh example of the present invention. FIG. 13A is a rear view showing a state after opening the battery package of FIG. 12. FIG. 13B is a side view showing a state after opening the battery package of FIG. 12. In this seventh example, the battery package 1 is fundamentally the same as that of the sixth example except for the mounting board. Therefore, corresponding parts and components to the sixth example are shown by the same numerals and marks, and the description thereon made in the sixth example similarly apply. In the following description, differences of this seventh example from the sixth example are mainly explained. There are such differences that the first perforation 2b1 is formed in a line from the lower edge of the mounting board 2 to an upper edge of the opening of the dent 4a, and that a thin part 2e is formed from the fourth perforation 2b4 to the lower edge of the mounting board 2.

As shown in FIG. 12, the first perforation 2b1 is formed between the lower edge of the mounting board 2 and the upper edge of the opening of the dent 4a (FIG. 9). The first perforation 2b1 is connected to the fifth perforation 2b5. As a result, even after opening of the battery package 1, an area of the protruded part 2d is larger than that of the sixth example. Thereby, it is possible to improve the maintainability of unused batteries 40.

Furthermore, the thin part 2e is formed on the protruded part 2d' parallel to the second perforation 2b2 between the lower edge of the mounting board 2 and the fourth perforation 2b4. The thin part 2e is formed on the protruded part 2d' by pressing so as to be easily bend the protruded part 2d' toward the inside the dent 4a. When unused batteries 40 are packed into the dent 4a, as shown in FIGS. 13A and 13B, the thin part 2e is bent toward inside of the dent 4a by contacting the side surfaces of the batteries 40 with the edge of the protruded part 2d'. Thereby, it is possible to prevent the batteries 40 from moving in the vertical direction within the battery package 1 during storing of the batteries 40. Furthermore, it is possible to keep the batteries 40 more stably than that of the sixth example.

<<EIGHTH EXAMPLE>>

Figure 14:
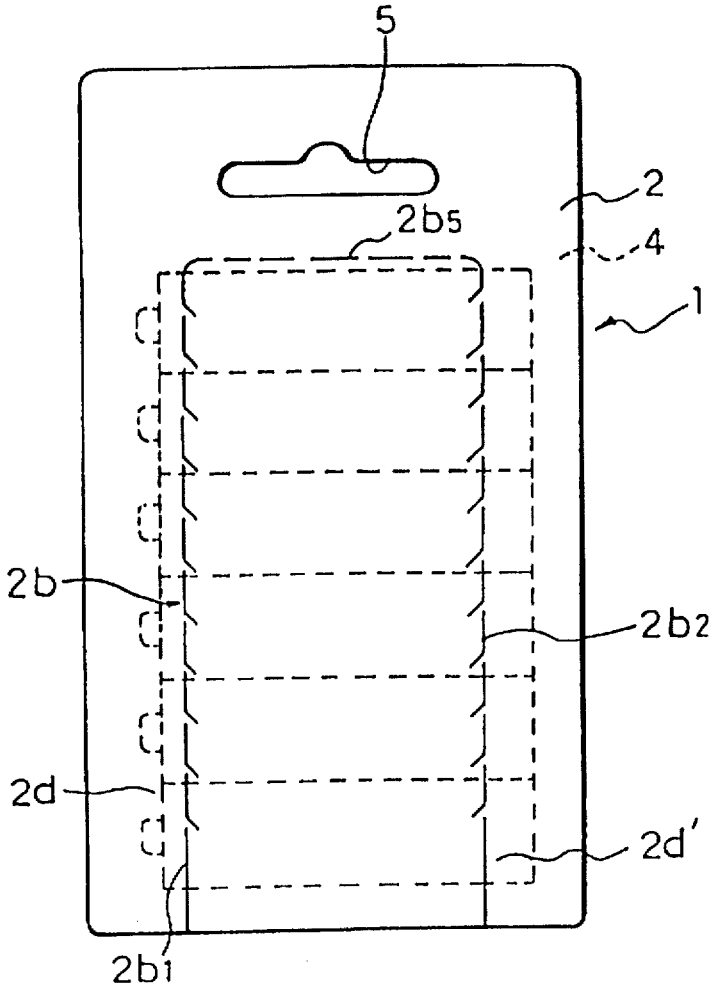
FIG. 14 is a rear view showing a battery package in an eighth example of the present invention.

FIG. 14 is a rear view showing a battery package in an eighth example of the present invention. In this eighth example, the battery package 1 is fundamentally the same as that of the sixth example except for the mounting board. Therefore, corresponding parts and components to the sixth example are shown by the same numerals and marks, and the description thereon made in the sixth example similarly apply. In the following description, differences of this eighth example from the sixth example are mainly explained. There are differences that the first and the second perforations 2b1 and 2b2 are formed ranging from the lower edge of the mounting board 2 to the upper edge of the opening of the dent 4a (FIG. 9) without the third and the fourth perforations 2b3 and 2b4 shown in FIG. 9.

As shown in FIG. 14, the first and the second perforations 2b1 and 2b2 extend up to the upper edge of the opening of the dent 4a from the lower edge of the mounting board 2. The first and the second perforations 2b1 and 2b2 are connected to the fifth perforation 2b5. As a result, when the battery package 1 is opened, the areas of the protruded parts 2d and 2d' are larger than those of the sixth example.

The battery package 1 is deformed in V-shape as viewed from above in so that a central portion of the front surface of the battery package 1 is a dent inside the deformed V-shape, thereby temporarily increasing the distance between the two protruded parts 2d and 2d'. As a result, the batteries 40 are taken out the battery package 1 and unused batteries 40 are packed in the battery package 1.

<<NINTH EXAMPLE>>

Figure 15A:
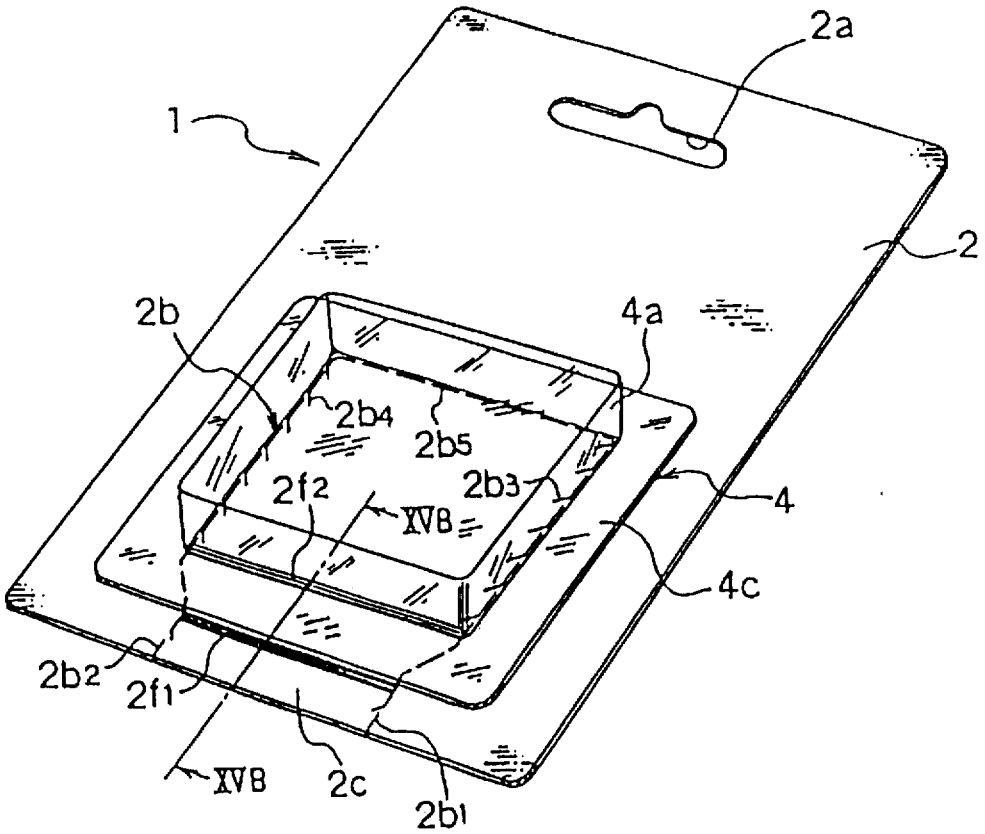
FIG. 15A is a perspective view showing a battery package in a ninth example of the present invention.
Figure 15B:
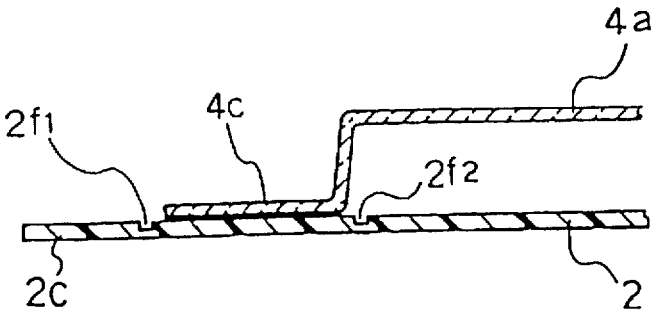
FIG. 15B is an enlarged cross sectional view, which is taken on line XVB—XVB, showing the battery package of FIG. 15A.
Figure 16:
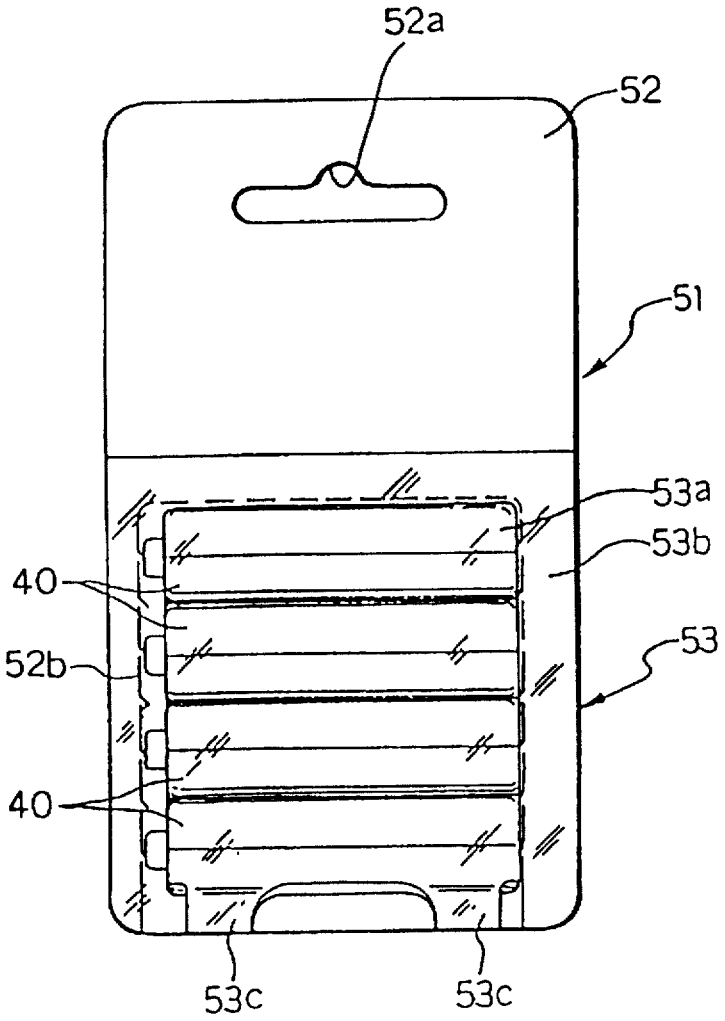
FIG. 16 (Prior Art)
FIG. 16 is a front view showing a conventional battery package.
Figure 17:
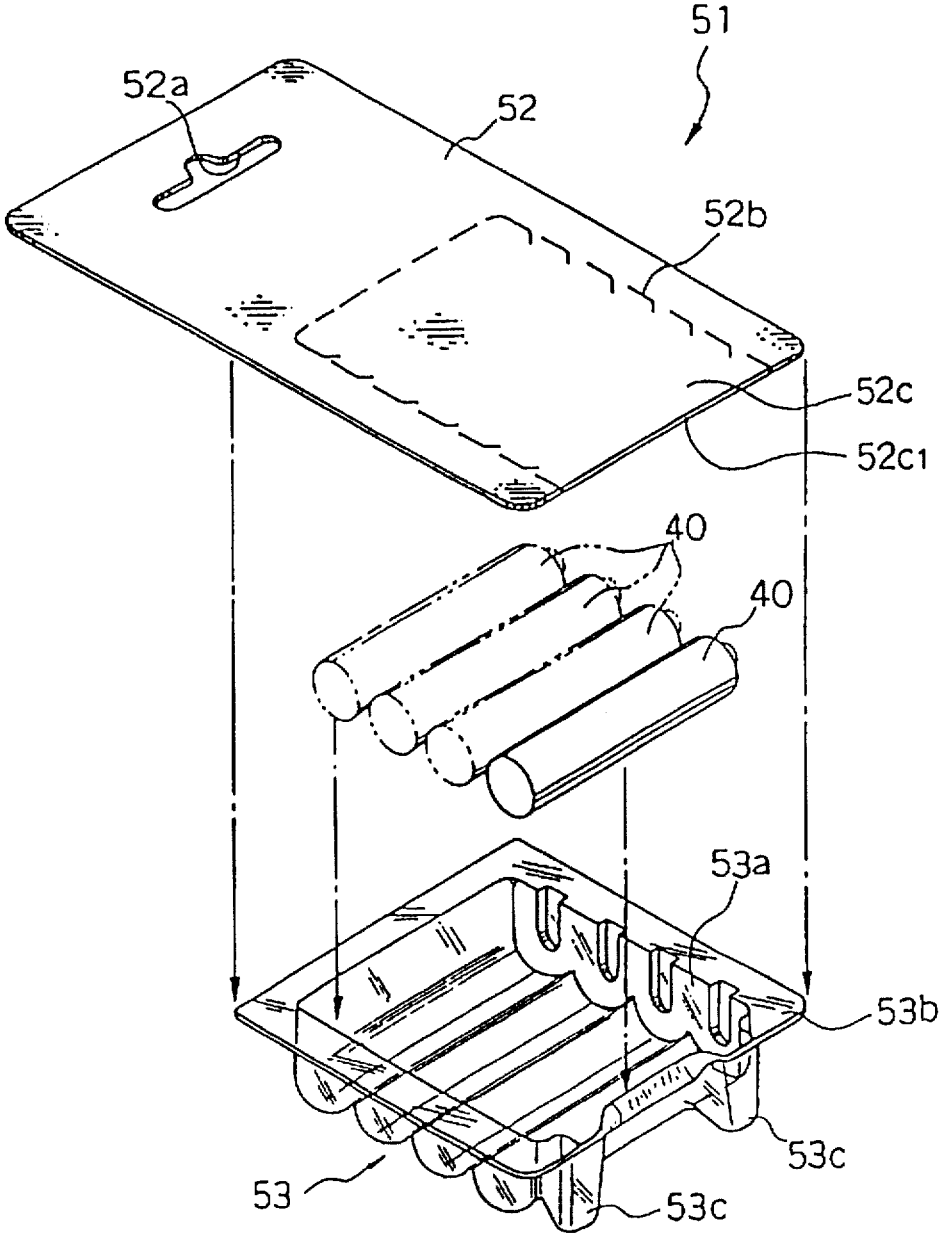
FIG. 17 (Prior Art)
FIG. 17 is an exploded perspective view showing conventional battery package is shown in FIG. 16.

FIG. 15A is a perspective view showing a battery package in a ninth example of the present invention. FIG. 15B is a cross sectional view, which is taken on line XVB—XVB, showing the battery package of FIG. 15A. In this ninth example, the battery package 1 is fundamentally the same as that of the sixth example except for the mounting board. Therefore, corresponding parts and components to the sixth example are shown by the same numerals and marks, and the description thereon made in the sixth example similarly apply. In the following description, differences of this ninth example from the sixth example are mainly explained. In FIGS. 15A and 15B, illustration of the packing part 3 is omitted for the sake of simplicity of drawings. There are differences that a first half cut-out part 2f1 and a second half cut-out part 2f2 are formed on the mounting board 2. The size of the mounting board is larger than the size of the outer circumference of the collar part 4c.

As shown in FIGS. 15A and 15B, the first half cut-out part 2f1 is formed on the mounting board 2 at a position between the lower edge of the mounting board 2 and the lower edge of the collar part 4c, across the first and the second perforations 2b1 and 2b2. Similarly, the second half cut-out part 2f2 is formed on the mounting board 2 along the inner edge of the collar part 4c across the third and the fourth perforations 2b3 and 2b4. Thereby, when the cutting part 2c is torn away from the mounting board 2, the cutting part 2c is separated into two parts at the part underneath the collar part 4c at the part between the first and the second half cut-out parts 2f1 and 2f2 in thickness direction of the mounting board 2. That is, a first separated part is a face part of the mounting board 2 bonded to the lower surface of the collar part 4c. The other separated part is a part which comes apart from the collar part 4c by peeling off the face part of the mounting board 2. Since the second half cut-out part 2f2 is formed inside the collar part 4c, it is easy to remove the cutting part 2c, and open the battery package 1.

Furthermore, a cut-out part 4h as shown in FIG. 8 may be formed on the collar part 4c at the part between the first and the second half cut-out parts 2f1 and 2f2.

Although the present invention has been described in terms of the presently preferred embodiments, it is to be understood that such disclosure is not to be interpreted as limiting. Various alterations and modifications will no doubt become apparent to those skilled in the art to which the present invention pertains, after having read the above disclosure. Accordingly, it is intended that the appended claims be interpreted as covering all alterations and modifications as fall within the true spirit and scope of the invention.

What is claimed is:

1. A merchandise package comprising:

a mounting board, a packing part including a substantially transparent plastic shrink-packing film for containing therein at least an article, and a holding part having a dent for containing the packing part and a collar part to be bonded to said mounting board, said holding part holding said packing part in cooperation with said mounting board.

2. A merchandise package in accordance with claim 1, wherein said articles is shrink-packed in said packing part so that each front faces of said article is directed to a predetermined direction.

3. A merchandise package in accordance with claim 1, wherein said holding part holds a plurality of said packing parts.

4. A merchandise package in accordance with claim 1, wherein a window part is formed on said dent.

5. A merchandise package in accordance with claim 4, wherein a folded part is formed at the periphery of said window part by folding an end part of said dent toward inside said dent.

6. A merchandise package in accordance with claim 4, wherein said window part is formed into one of a rectangular shape and an oval shape.

7. A merchandise package in accordance with claim 4, wherein at least one separating part is formed on said dent and said collar part extending between an edge of said collar part and said window part.

8. A merchandise package in accordance with claim 1, wherein:

two perforations are formed in said mounting board with a predetermined distance therebetween ranging from one edge toward the other edge of said mounting board, and a cut-out part is formed in said collar part at a position between said two perforations at said one edge, said cut-out part opening toward said one edge of said mounting board.

9. A merchandise package in accordance with claim 1, wherein:

two perforations are formed in said mounting board with a predetermined distance therebetween ranging from one edge toward the other edge of said mounting board, and a half cut-out part is formed in said collar part between said two perforations at said one edge, said cut-out part opening toward said one edge of said mounting board.

10. A merchandise packaging in accordance with claim 1, wherein:

two perforations are formed in said mounting board with a predetermined distance therebetween ranging from one edge toward the other edge of said mounting board, and a perforated cut-out part is formed in said collar part between said two perforations at said one edge, said cut-out part opening toward said one edge of said mounting board.

11. A merchandise package in accordance with claim 1, wherein:

two perforations are formed in said mounting board with a predetermined distance therebetween ranging from one edge toward the other edge of said mounting board, and said mounting board and said collar part are bonded to each other in a region outside said two perforations.

12. A merchandise package in accordance with claim 1, wherein:

two perforations are formed in said mounting board with a predetermined distance therebetween ranging from one edge toward the other edge of said mounting board, and a distance between said two perforations is smaller than an opening width of said opening of said dent.

13. A merchandise package in accordance with claim 1, wherein:

two perforations are formed in said mounting board with a predetermined distance therebetween ranging from one edge toward the other edge of said mounting board, and at least two half cut-out parts are formed on said mounting board at a position between said one edge of said mounting board and said other edge of said mounting board across said two perforations.

14. A merchandise package in accordance with claim 13, wherein one of said at least two half cut-out parts is formed on said mounting board at a position between said one edge of said mounting board and said collar part, and the other of said at least two half cut-out parts is formed on said mounting board at a position inside said collar part.

15. A method of manufacturing a merchandise package, in which a mounting board is bonded to a holding part of a synthetic resin, said holding part having a dent for packing said articles and a collar part being formed around said dent and bonded to said mounting board, said method comprising the steps of:

pressing and heating a metal mold against said synthetic resin sheet for forming said dent, and cutting through said synthetic resin sheet by an arc-shape blade disposed in said metal mold for forming an arc-shaped cutting part in said synthetic resin sheet.

* * * * *